United States Patent [19]

Schneider et al.

[11] Patent Number: 4,716,846

[45] Date of Patent: Jan. 5, 1988

[54] SEWING MACHINE WITH WORKPIECE HOLDER FOR SECURING INITIAL SEAM STITCHES

[75] Inventors: Franz Schneider; Herbert Wenz; Günter Link, all of Kaiserslautern, Fed. Rep. of Germany

[73] Assignee: Pfaff Industriemaschinen GmbH, Fed. Rep. of Germany

[21] Appl. No.: 924,860

[22] Filed: Oct. 29, 1986

[30] Foreign Application Priority Data

Dec. 6, 1985 [DE] Fed. Rep. of Germany ..... 3543133

[51] Int. Cl.[4] ..... D05B 29/02

[52] U.S. Cl. ..... 112/239; 112/236; 112/266.1

[58] Field of Search ..... 112/311, 320, 236, 239, 112/266.1, 262.1, 60, 61

[56] References Cited

U.S. PATENT DOCUMENTS

| | | | |
|---|---|---|---|
| 662,505 | 11/1900 | Steward | 112/311 |
| 1,280,947 | 10/1918 | Beckwith | 112/239 |
| 2,242,688 | 5/1941 | Unger | 112/239 |
| 2,413,277 | 12/1946 | Zeier | 112/255 |
| 3,282,237 | 11/1966 | Niekrawietz | 112/236 |
| 4,454,830 | 6/1984 | Bennett | 112/239 |
| 4,513,675 | 4/1985 | Meyer et al. | 112/236 |
| 4,524,707 | 6/1985 | Sander | 112/152 |
| 4,538,533 | 9/1985 | Ohchi et al. | 112/239 |
| 4,587,911 | 5/1986 | Kinoshita | 112/239 |

FOREIGN PATENT DOCUMENTS 1961375 3/1967 Fed. Rep. of Germany .

*Primary Examiner*—Andrew M. Falik

*Attorney, Agent, or Firm*—McGlew and Tuttle

[57] ABSTRACT

A sewing machine which is used with manual feed movement of a sewing material has a holding device for the material that is effective during the first phases of stitching of a seam section, by which the first thread knot is held from becoming undone when short thread ends and a large feed movement are used. In a first embodiment, the holding device includes a holding foot, by a drive mechanism in addition to a presser foot which is periodically moved up and down by a drive mechanism, and a controllable drive for the holding foot. In a second embodiment, the holding device includes a presser foot, a compression spring and a decoupling mechanism by which the presser foot can be disconnected from its drive mechanism.

10 Claims, 8 Drawing Figures

SEWING MACHINE WITH WORKPIECE HOLDER FOR SECURING INITIAL SEAM STITCHES

FIELD AND BACKGROUND OF THE INVENTION

The present invention relates in general to sewing machines, and in particular to a new and useful sewing machine with a needle capable of moving up and down and presser foot which is periodically moved up and down by means of a drive mechanism for carrying out manual feed movements of the sewing material, and including a holding device for the sewing material which is connectable at the beginning of a seam section to be sewn, and disconnectable after a brief predetermined number of stitching procedures.

Such sewing machines, known, for example from German GM (utility model) No. 1 961 375, are useful for making lounge jackets and coats with underlying padding, sewing in linings and for the production and sewing on of shoulder pads. Since, with these sewing machines, the transporting of the sewing material is usually carried out by hand and thus very large movements of several centimeters sometimes take place, the danger exists at the start of the sewing operation, that the thread knot formed at the first stitch, which is not yet firmly anchored in the sewing material, will become undone. This danger is greater the shorter the thread ends are at the start of sewing. Since in the case of sewing machines with a thread-cutting arrangement, in contrast to manual thread cutting, comparatively short thread ends are produced that are connected to the actual thread supply. For that reason an increased danger of undoing the first thread knot exists with such machines, or else sewing on the first thread part requires special attention and caution from the operator.

SUMMARY OF THE INVENTION

The object of the invention is based on building or equipping the sewing machine so that a secure thread knot at the onset or start of sewing is also assured with short thread ends.

By the arrangement of a holding device for the sewing material operative only at the onset of sewing, the operator is hindered from moving the material immediately after the formation of the first stitch or of the first knot. A selectable number of stiches is thus carried out at one and the same location on the sewing material, whereby the knots thus formed are firmly anchored in the material. When the holding device then releases the sewing material, the operator may move the material immediately as far as is desired without the danger of having the first knot undone.

Accordingly, another object of the invention is to provide the sewing machine with a holding device which is formed of a holding foot which can be lowered onto the sewing material in the area of the stitching location, by means of a controllable drive. The holding foot is arranged on a shaft which is pressed by means of a spring and axially displaceable, essentially perpendicular to the plane of the sewing material. This shaft is connected to drive means acting against the spring and connected to a control device. This first embodiment of the holding device has the advantage that it can be built as an addition onto already existing machines.

In a second embodiment of the invention, the existing presser foot is used for holding the sewing material fast. It is disconnected from its drive mechanism, that normally make periodic up and down movements, by means of a circuit-breaker or decoupling mechanism and is pressed downwardly on the sewing material during the desired length of time by means of a spring. By the measure of using the normally periodically moved presser foot also as a holding foot at the onset of sewing, no additional component is necessary in the area of the stitching location for carrying out the holding function, so that in this form of the holding device, the view of the stitching location and handling of the sewing material are not hindered.

A further object of the invention is to provide a sewing machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

The invention is illustrated by means of two working examples represented in the drawings, wherein.

DESCRIPTION OF THE PREFERRED EMBODIMENTS

Figure 1:
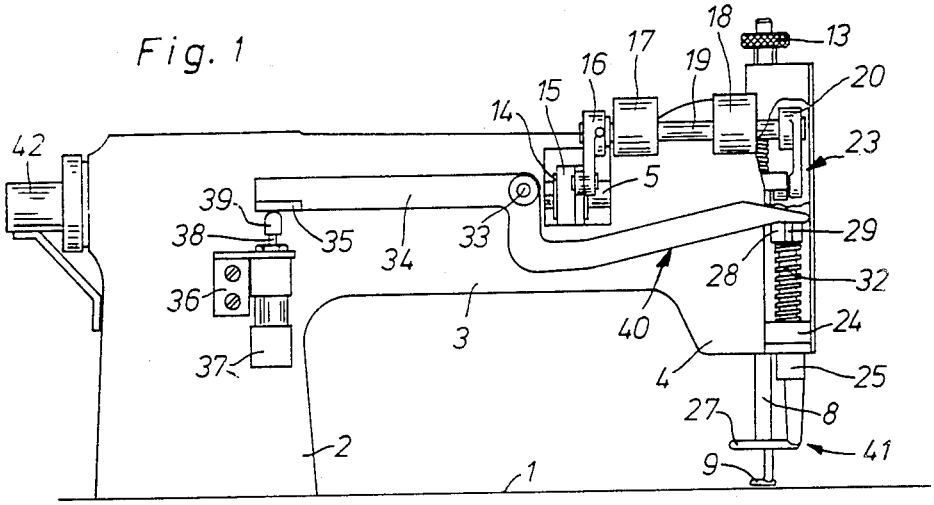
FIG. 1 is a rear elevational view of a sewing machine with a presser foot and an additionally arranged holding foot.

Referring to the drawings in particular, the invention embodied therein comprises a sewing machine which has a need shaft for carrying a sewing needle, needle drive means for moving the needle shaft up and down to form stitches in a material at a stitching location to produce a seam in the material, a presser foot for holding the material, presser foot drive means for periodically raising and lowering the presser foot to hold the material in synchronism with the formation of stitches and to release the material to permit manual movement of the material, and holding means engageable with the material, preferably near the stitching location, for holding the material during the formation of a plurality of initial stitches whereby the initial stitches are retained in the material even after the holding means as well as the presser foot releases the material.

FIRST WORKING EXAMPLE

Figure 2:
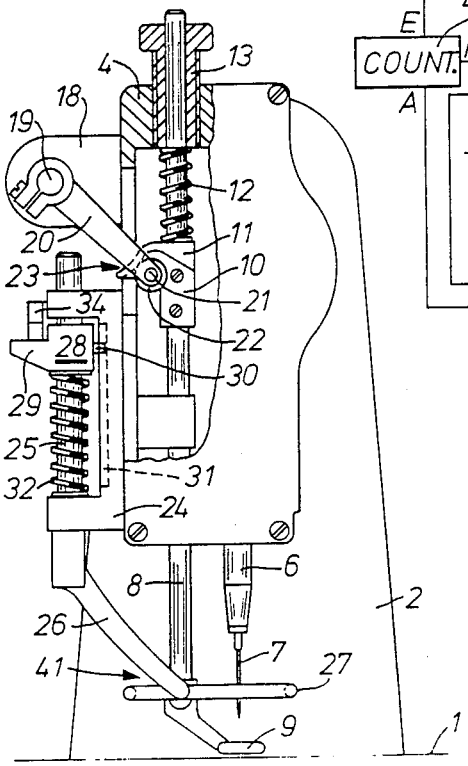
FIG. 2 is a partially sectional side elevational view of the sewing machine according to FIG. 1.
Figure 3:
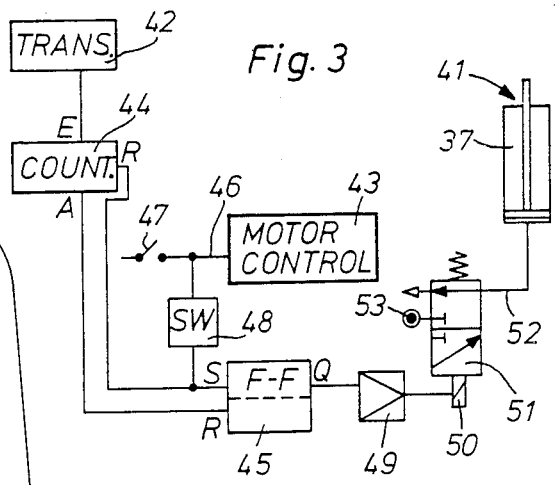
FIG. 3 is a simplified block circuit diagram of the control for the holding device.

The sewing machine of the invention, as shown in FIGS. 1 to 3, comprises a foundation plate 1, a post 2 and an arm 3 which goes across into a head 4. A primary axle or drive shaft 5 mounted in the arm 3 drives a needle shaft 6 mounted in the head 4 in the usual way, the thread-guiding needle 7 of this needle shaft working together with a thread catcher (not shown) to form stitches in a material (not shown).

A presser bar 8 which bears a presser foot 9 is also arranged in the head 4. A lifting piece 10 which has a laterally projecting, essentially curved attachment 11 is attached to the presser bar 8.

Also arranged on the presser bar 8 is a compression spring 12 which is braced on one end on the lifting piece 10 and on the other end on an adjustable bushing 13 screwed into the head 4.

A cam 14, held by a eccentric rod 15, is attached to the primary axle or drive shaft 5. The eccentric rod 15 is linked to a lever 16 which is attached to an independent axle 19 mounted in two feed heads 17, 18. A lever 20 is attached to the independent shaft 19. A bolt 21 is arranged on lever 20 and supports a roller 22 engaged against and below the attachment 11 of the lifting piece 10. Components 10–22 constitute a drive mechanism 23 for the presser bar 8 and the presser foot 9.

A shaft 25 is displaceably mounted in a U-shaped bracket 24 attached to the back side of the head 4, an arm 26 being built on the lower end of said shaft and bearing an annular holding foot 27. A catch piece 28 which has a laterally projecting attachment 29 is attached to the shaft 25. A pin 30, attached to the catch piece 28, interlocks in a vertical guide slot 31 built in the bracket 24 and prevents the shaft 25 from dislocating. A compression spring 32, which is supported on one end on the bracket 24 and on the other end on the catch piece 28, is arranged on the shaft 25.

A two-armed lever 34, whose forward end lies on the attachment 29 of the catch piece 28, is mounted on a bolt 33 on the back side of the arm 3. A transversely projecting striking plate 35 is arranged on the rear end of the lever 34. An angle plate 36, which bears a simply operating compressed-air cylinder 37, is attached to the back side of the post 2. A pressing piece 39, which works together with the striking plate 35, is attached to the piston rod 38 of the compressed air cylinder 37. Components 28 - 39 constitute a drive 40 for the holding foot 27. The shaft 25 and the holding foot 27, together with the drive 40, form a holding device 41 for the sewing material.

A known positioning motor (not shown) serves to drive the sewing machine, an impulse transmitter 42 being arranged on the primary axle 5 for the synchronous control of this motor with respect to the movement of the needle shaft 6. The exact control of the positioning motor, familiar in itself, is only symbolically represented in FIG. 3 and carries the reference number 43.

For the control of the holding device 41, the impulse transmitter 42 is connected with the input E of a preselection counter 44 constructed for counting backwards, the output A of said pre-selection counter being connected to the reset input R of a flip-flop 45. A monostable tumble switch 48, whose outputs are connected on one side with the reset input R of the preselection counter 44 and on the other side with the set input S of the flip-flp 45, is connected to the connecting line 46 between a pedal 47, serving to turn the positioning motor on and off, and the motor control 43. An amplifying circuit 49, which is connected to the switching magnet 50 of a 3/2 direction valve, is connected to the output Q of the flip-flop 45. The direction valve 51 is connected to the compressed air cylinder 37 through a hose line 52. The compressed air source is denoted by 53.

SECOND WORKING EXAMPLE

The sewing machine shown in FIGS. 4 to 8 comprises a foundation plate 60, a post 61 and an arm 62 which goes over a head 63. A primary axle 64 mounted in the arm 62 drives a needle shaft 65 mounted in the head 63 in a known manner. The thread guiding needle 66 of the needle shaft works together with a catcher (not shown) to form stitches.

A presser bar 67 bearing a presser foot 68 is arranged in the head 63. A catch piece 69 which has a laterally projecting attachment 70 is attached to the presser bar 67. A displaceable coupling bolt 72 is arranged in the attachment 70 transverse to the longitudinal axis 71 of the presser bar 67, the outwardly directed end of said coupling bolt being provided with a head 73. A protective washer 74 (FIG. 6), immovable in the axial direction, is arranged on the coupling bolt 72. A sack bore 75 whose diameter is larger than the diameter of the protective washer 74 is built into the attachment 70. A compression spring 76 arranged on the coupling bolt 72 is supported on one end on the protective washer 74 and on the other end on a cover plate 77 which is fastened to the attachment 70 by means of a screw 78.

A lifting piece 79 is displaceably arranged on the presser bar 67, said lifting piece consisting of an upper and a lower bearing component 80, 81 (FIG. 6), a connecting part 82 and an essentially curved, laterally projecting, attachment 83 built on the upper bearing component 80. A receiving bore for the coupling bolt 72 is contained in the connecting part 82.

Also arranged on the presser bar 67 is a compression spring 85 which is supported on one end on the lifting piece 79 and on the other end on an adjustable threaded bushing 86 screwed into the head 63. The threaded bushing 86 has a longitudinal bore 87 (FIG. 7) serving to guide the presser bar 67. In a longitudinal bore 88, which is built in the presser bar 67 and which ends above the attachment site of the catch piece 69, are arranged a compression spring 89 (FIG. 7) and above it a displaceable pin 90 which partially projects out of the longitudinal bore 88. The compression spring 89 is tensed across the pin 90 by means of a screw 91.

An eccentric 92, which is held by a eccentric rod 93, is attached to the primary axle 64. The eccentric rod 93 is linked to a lever 94 which is attached to an independent axle 97 mounted in two feed heads 95, 96. A lever 98 is attached to the independent axle 97. A bolt 99 is arranged on lever 98 which supports a roller 100 engaged against and below the attachment 83 of the lifting piece 79. Components 69–100 constitute a drive mechanism 101 for the presser bar 67 and the presser foot 68.

A doubly operating compressed air cylinder 103, whose piston rod 104 bears an angular detent piece 105, is attached to the head cover 102 enclosing the head 63. The free end of the detent piece 105 is angled off obliquely, which results in an inclined surface 106 turned towards the head 73 of the coupling bolt 72. the detent piece 105 has a vertical slot 107 (FIG. 6) in the area of the inclined surface 106, the width of said slot being larger than the diameter of the coupling bolt 72. Components 103 and 105 constitute a mechanical circuit-breaker or decoupling mechanism 108, by means of which the presser bar 67 with the presser foot 68 can be disconnected from the drive mechanism 101. The circuit-breaker or decoupling mechanism 108, the presser bar 67 with the presser foot 68 disconnected from the drive mechanism 101 and the compression spring 89, which is supported across the pin 90 on the screw 91 together constitutes a holding device 109, for the sewing material.

Figure 8:
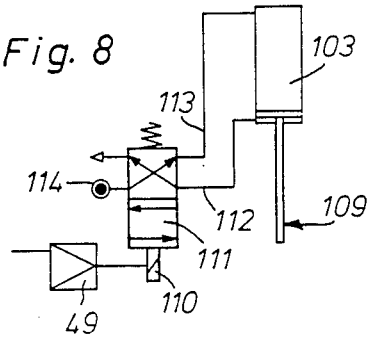
FIG. 8 is a diagram of the pneumatic portion of a circuit for the holding device.
Figure 4:
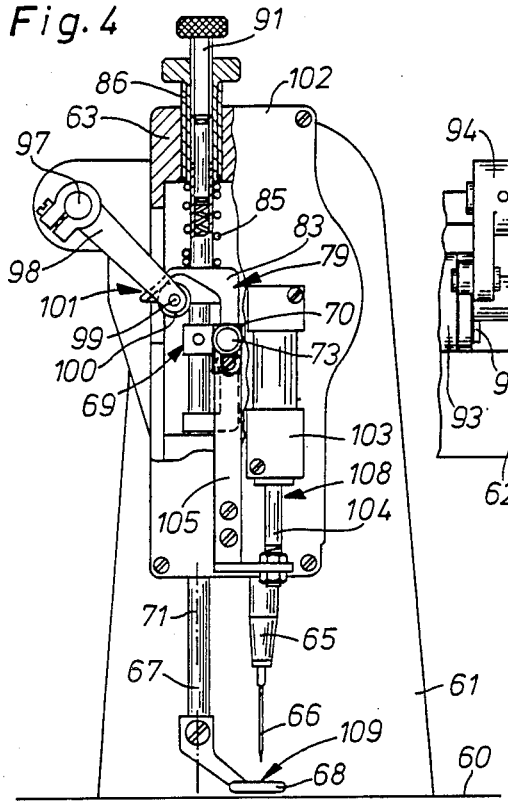
FIG. 4 is a partially sectioned side elevational view of a sewing machine with the second working example of the holding device.
Figure 5:
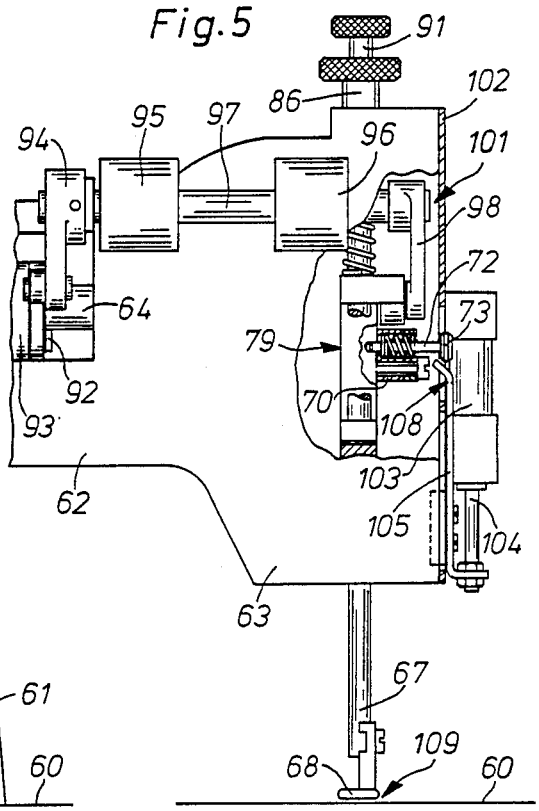
FIG. 5 is a rear elevational view of a portion of the sewing machine according to FIG. 4.
Figure 6:
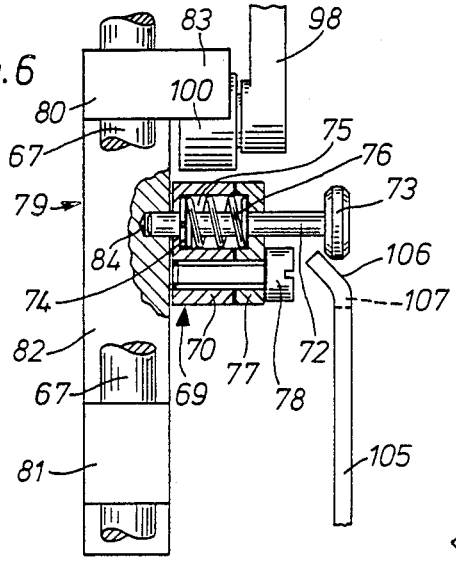
FIG. 6 is an enlarged partial section according to FIG. 5 illustrating the coupling joint between the catch piece and the lifting piece on the presser bar.
Figure 7:
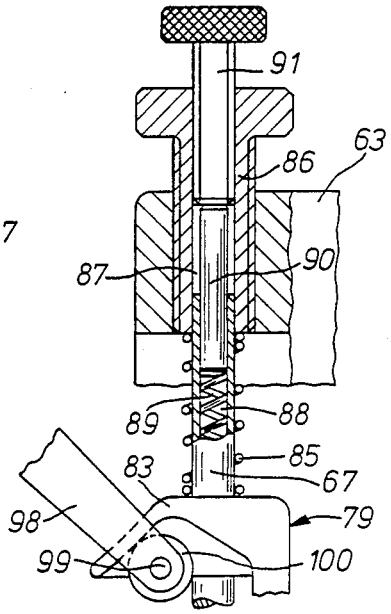
FIG. 7 is an enlarged partial section according to FIG. 4 illustrating the arrangement of the compression spring working on the pressure bar.

The portion consisting of components 42–49 of the circuit illustrated in FIG. 3 is used for controlling the holding device 109, i.e. for controlling the compressed air cylinder 103. The output of the amplifying circuit 49 is connected with the switching magnet 110 of a 3/2 direction valve as shown in FIG. 8. The direction valve 111 is connected with the compressed air cylinder 103 through two hose lines 112, 113. The compressed air source is denoted by 114.

OPERATION OF FIRST WORKING EXAMPLE

In an inactive sewing machine, the lever 20 (FIGS. 1 and 2) situated in its upwardly turned position, holds the presser bar 8 with the presser foot 9 in a raised position. Further when the sewing machine is inactive the compressed air cylinder 37 is ventilated, which results in the compression spring 32 over the catch piece 28 holding the shaft 25 with the holding foot 27 likewise in a raised position.

After the sewing material has been correctly placed on the foundation plate 1 under the presser foot 9 and the holding foot 27 for the onset of sewing, the positioning motor (not shown) is turned on through the motor control 43 (FIG. 3) by stepping down on the pedal 47 and the sewing machine is set in motion. At the same time the monostable tumble switch 48 is activated, thus giving off an isolated impulse. The isolated impulse conveyed to the reset input R of the preselection counter 44 causes the preselection counter 44 to be returned to a preset number, e.g. 3. This number represents the number of stitches desired for this sewing procedure during which the holding device 41 should be effective.

The isolated impulse given off by the monostable tumbler switch 48 is at the same time conveyed to the set input S of the flip-flop 45, whereupon a continuous H-signal is fixed on the output Q of the flip-flop. The H-signal is amplified in the amplifying circuit 49 to such an extent that the switching magnet 50 is activated with the output current and the direction valve 51 is consequently switched over. As a result the compressed air cylinder 37 is activated, the piston rod 38 moves upwardly, the lever 34 tilts against the action of the compression spring 32 and the shaft 25 with the holding foot 27 moves downwards, until the holding foot 27 lies on the sewing material and presses it against the foundation plate 1. The individual steps of this function follow so quickly that the holding foot 27 is lowered onto the sewing material virtually immediately after the activation of the pedal 47. This ensures a displacement of the material in the area of the stitching location, which is the puncturing site for the needle 7 in to the sewing material.

During the running of the sewing machine, the cam 14 of the independent axle 19 imparts swinging movements across the cam shaft 15 and the lever 16, said movements being transferred across the lever 20 and the roller 22 to the lifting piece 10 and thus to the presser bar 8. The up-and-down motion of the presser bar 8 or of the presser foot 9 resulting once during a stitching procedure is adjusted to the movement of the needle shaft 6 so that the presser foot 9 is set on the sewing material before the needle 7 punctures the material and only lifts up from the sewing material again when the needle 7 is out of the material.

During the first three stitching procedures, the holding foot 27 holds the sewing material fast or stationary on the foundation plate 1, so that the thread knots of these three stitches follow on the same location of the sewing material and are thus firmly anchored in it.

After the three stitching procedures the backwards counting preselection counter 44 has reached the counter position zero, whereupon it gives off an output signal which is conveyed to the reset input R of the flip-flop 45. The reset signal cuases the flip-flop 45 to switch to the other circuit position, whereupon an L-signal is fixed on the output Q. Because of the L-signal the output of the amplifying circuit 49 is without current, so that the switching magnet falls off and the direction valve 51 is switched over into the circuit position represented in FIG. 3. This has the result that the compressed air cylidner 37 is ventilated and the compression spring 32 over the catch piece 28 raises the shaft 25 with the holding foot 27. The operator can then freely move the sewing material on the foundation plate 1 during the time when the periodially moved presser foot 9 is withdrawn from the sewing material.

OPERATION OF SECOND WORKING EXAMPLE

In an inactive sewing machine, the lever 98 (FIGS. 4 to 7) situated in its upwardly turned position holds the lifting piece 79 and the catch piece 69 across the coupling bolt 72 locked in the receiving bore 84, the presser bar 67 with the presser foot 68 in a raised position.

After the sewing material has been correctly placed on the foundation plate 60 under the presser foot 68 for the onset of sewing, the positioning motor (not shown) is turned on through the motor control 43 by stepping down on the pedal 47 and the sewing machine is set in motion. At the same time the monostable tumber switch 48 (FIG. 3) is activated, thus giving off an isolated impulse. By means of the isolated impulse, the preselection indicator is returned to preset number, e.g. 3, on the one hand, and on the other, the flip-flop 45 switches into a circuit position such that a continuous H-signal is fixed on its output Q. The H-signal is amplified in the amplifying circuit 49 to such an extent that the switching magnet 110 (FIG. 8) is activated with the output current and as a result the direction valve 111 is switched over. As a result, the compressed air cylinder 103 is reversed, so that the piston rod 104 with the detent piece 105 is moved upwards.

Through the upward movement of the detent piece 105, the coupling bolt 72 is withdrawn against the action of the compression spring 76 and the coupling joint between the lifting piece 79 and the catch piece 69 is thereby disconnected. This has the result that the compression spring 89 moves the presser bar 67 with the presser foot 68 downwardly until the presser foot 68 lies on the sewing material and presses it against the foundation plate 60. The individual steps of this function follow so quickly that the presser bar 67 is disconnected from the lifting piece 79 virtually immediately after the activation of the pedal 47 and the presser foot 68 is lowered onto the sewing material.

While the sewing machine is running, the eccentric 92 of the independent axle 97 imparts swinging movements which are carried across the lever 98 and the roller 100 to the lifting piece 79. As long as the coupling joint between the lifting piece 79 and the catch piece 69 is broken, the lifting piece 79 carries out periodic idling motions along the presser bar 67, stationary in the lowered position.

During the first three stitching procedures, the lowered presser foot 68 holds the sewing material fast on the foundation plate 60, so that the thread knots of these three stitches follow on the same location of the sewing material and are thereby firmly anchored in it.

After ending the three stitching procedures, the preselection counter 44 has reached the counter position zero, when it gives off an output signal. This output signal causes, as already described for working example 1, the output of the amplifying circuit 49 to be without current and therefore the switching magnet 110 to fall off and the direction valve 111 to be switched over into the circuit position shown in FIG. 8. By the stitching of the direction valve 111, the compressed air cylinder 103 is reversed and the piston rod 104 with the detent piece 105 again moves downwards. This has the result that the coupling bolt 72 is released, so that the compression spring 76, at the next lowered position of the lifting piece 79, pushes it into the receiving bore 84 of said lifting piece and thus again creates a coupling joint between the lifting piece 79 and the catch piece 69.

Afterwards the presser bar 67 with the presser foot 68 again takes part in the periodic up-and-down movement of the lifting piece 79, so that the operator can freely move the sewing material on the foundation plate 60 during the time when the presser foot 68 is withdrawn from the material.

While specific embodiments of the invention have been shown and described in detail to illustrate the application of the principles of the invention, it will be understood that the invention may be embodied otherwise without departing from such principles.

What is claimed is:

1. A sewing machine comprising, a needle shaft for carrying a sewing needle, needle drive means for moving the needle shaft up and down to form stitches in a material at a stitching location, a presser foot for holding the material near the stitching location, presser foot drive means for periodically raising and lowering the presser foot to hold the material in synchronism with the formation of stitches and to release the material to permit manual movement of the material, and holding means associated with said sewing machine for engaging the material near the stitching location to continuously hold the material stationary during the formation of a selected plurality of initial stitches.

2. A sewing machine according to claim 1, wherein said holding means comprises a holding foot mounted for movement downwardly onto the material and for movement upwardly away from the material near the stitching location, and controllable drive means connected to the holding foot for lowering the holding foot to engage said material during the selected plurality of initial stitches and for raising the holding foot to release the said material after the formation of the selected plurality of initial stitches.

3. A sewing machine according to claim 2, including a holding foot shaft connected to said holding foot and mounted for axial movement in a direction perpendicular to the plane of the stitching location, a spring engaged with said holding foot for biasing said holding foot against the material at the stitching location, and holding foot drive means operatively connected to said controllable drive means for urging said spring downwardly to lower said holding foot and bias said holding foot downwardly against said material at said stitching location.

4. A sewing machine comprising, a needle shaft for carrying a sewing needle, needle drive means for moving the needle shaft up and down to form stitches in a material at a stitching location, a presser foot for holding the material near the stitching location, presser foot drive means for periodically raising and lowering the presser foot to hold the material in synchronism with the formation of stitches and to release the material to permit manual movement of the material, and holding means for engaging the material near the stitching location to hold the material during the formation of a selected plurality of initial stitches, said holding means includes said pressure foot, controllable decoupling means operatively connected between said presser foot drive means and said presser foot for selectively coupling and decoupling said presser foot drive means to and from said presser foot, and a first spring engaged with said presser foot for biasing said presser foot downwardly toward said stitching location.

5. A sewing machine according to claim 4, wherein said presser foot includes a presser bar axially movable toward and away from said stitching location, a second spring for biasing said presser foot downwardly toward said stitching location, said decoupling means comprising a catch piece fixed to said presser bar and bearing a coupling bolt which is mounted for a movement which is transverse to the axial movement of said presser bar, a third spring engaged with said bolt for biasing said bolt into a coupled position with a lifting piece, engaged with said presser bar for displacement therealong and provided with a receiving bore, said coupling bolt in its coupled position being engaged in said receiving bore for mechanically connecting said presser bar with said lifting piece, said decoupling means including a detent piece mounted for movement into and out of engagement with said coupling bolt for removing said coupling bolt from said receiving bore to disconnect said presser bar from said lifting piece, and a piston plus cylinder combination having a piston connected to said detent piece for moving said detent piece.

6. A sewing machine according to claim 5, wherein said coupling bolt has a head, said detent piece having an inclined surface at one end thereof engageable with said head for moving said coupling bolt.

7. A method of sewing a material with a seam having a plurality of stitches including a selected number of initial stitches, and using a sewing machine having a needle and a presser foot, comprising moving the needle upwardly and downwardly into and out of engagement with the material for forming the stitches at a stitching location, moving the presser foot in synchronism with the needle into engagement with the material when the needle is in the material and out of engagement with the material when the needle is out of the material, manually feeding the material when the needle is out of the material to form a seam with the stitches, and, during the formation of the selected plurality of initial stitches, and continuously holding the material stationary at the stitching location during movement of the needle to form the plurality of initial stitches.

8. A method according to claim 7, including holding the material at the stitching location using a holding foot which is separate from the presser foot.

9. A method according to claim 7, including holding the material at the stitching location by holding the presser foot down in its engaged position with the material during the formation of the initial plurality of stitches.

10. A method of sewing a material with a seam having a plurality of stitches including a selected number of initial stitches, and using a sewing machine having a needle and a presser foot, comprising moving the needle upwardly and downwardly into and out of engagement with the material for forming the stitches at a stitching location, moving the presser foot in synchronism with the needle into engagement with the material when the needle is in the material and out of engagement with the material when the needle is out of the material, manually feeding the material when the needle is out of the material to form a seam with the stitches, and, during the formation of the selected plurality of initial stitches, and continuously holding the material stationary at the stitching location during movement of the needle to form the plurality of initial stitches, holding the material at the stitching location being done by using a holding foot which is separate from the presser foot.

* * * * *